US009721516B2

(12) United States Patent
Kim et al.

(10) Patent No.: US 9,721,516 B2
(45) Date of Patent: Aug. 1, 2017

(54) METHOD OF DRIVING DISPLAY PANEL AND DISPLAY DEVICE INCLUDING THE DISPLAY PANEL

(71) Applicant: Samsung Display Co., Ltd., Yongin, Gyeonggi-Do (KR)

(72) Inventors: Sang-Mi Kim, Yongin-si (KR); Kyoung-Won Lee, Seoul (KR); Su-Hyeong Park, Gyeongju-si (KR); Cheol-Woo Park, Suwon-si (KR); Ho-Yong Jung, Seongnam-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 42 days.

(21) Appl. No.: 14/502,872

(22) Filed: Sep. 30, 2014

(65) Prior Publication Data

US 2015/0194122 A1 Jul. 9, 2015

(30) Foreign Application Priority Data

Jan. 8, 2014 (KR) ..... 10-2014-0002233

(51) Int. Cl.
*G09G 3/36* (2006.01)

(52) U.S. Cl.
CPC ..... *G09G 3/3614* (2013.01); *G09G 3/3655* (2013.01); *G09G 3/3688* (2013.01);
(Continued)

(58) Field of Classification Search
None
See application file for complete search history.

(56) References Cited

U.S. PATENT DOCUMENTS 8,164,556 B2 4/2012 Song et al.
2005/0068282 A1* 3/2005 Mizumaki ..... G09G 3/3611 345/89

(Continued)

FOREIGN PATENT DOCUMENTS

KR 10-2006-0128447 A 12/2006
KR 10-2007-0074091 A 7/2007

(Continued)

OTHER PUBLICATIONS

Mizusaki et al., "Generation mechanism of residual direct current voltage in a liquid crystal display and its evaluation parameters related to liquid crystal and alignment layer materials," *J. Appl. Phys.* 102, pp. 014904-1 thru 014904-6, (2007).

*Primary Examiner* — Joseph Haley
*Assistant Examiner* — Emily Frank
(74) *Attorney, Agent, or Firm* — Knobbe Martens Olson & Bear LLP

(57) ABSTRACT

A method of driving a display panel and display device including the same are disclosed. In one aspect, the method comprises providing input image data, generating a gamma reference voltage, generating a data voltage based on the gamma reference voltage and input image data, providing the data voltage to the display panel, and determining whether the input image data represents a still image or a video image. The method further comprises substantially periodically and alternately generating first and second common voltages when the input image data represents the still image, and providing the first and second common voltages to the display panel.

19 Claims, 14 Drawing Sheets

(52) U.S. Cl.
CPC ..... *G09G 2320/0204* (2013.01); *G09G 2320/0242* (2013.01); *G09G 2320/0257* (2013.01); *G09G 2320/0276* (2013.01); *G09G 2320/0673* (2013.01); *G09G 2320/103* (2013.01); *G09G 2330/023* (2013.01)

(56) References Cited

U.S. PATENT DOCUMENTS

| | | | | |
|---|---|---|---|---|
| 2006/0187158 | A1* | 8/2006 | Wakabayashi | G06F 3/1446 345/87 |
| 2009/0278869 | A1* | 11/2009 | Oishi | G09G 3/2025 345/691 |
| 2011/0074761 | A1* | 3/2011 | Xiao | G09G 3/3614 345/211 |
| 2011/0102400 | A1 | 5/2011 | Ji | |
| 2011/0115779 | A1* | 5/2011 | Fujikawa | G09G 3/3614 345/212 |
| 2012/0200551 | A1 | 8/2012 | Liu et al. | |
| 2014/0218413 | A1* | 8/2014 | Yu | G09G 3/3648 345/690 |

FOREIGN PATENT DOCUMENTS

| | | | |
|---|---|---|---|
| KR | 10-2009-0028869 | A | 3/2009 |
| KR | 10-2009-0118616 | A | 11/2009 |
| KR | 10-2011-0070177 | A | 6/2011 |
| KR | 10-1167315 | B1 | 7/2012 |

* cited by examiner

METHOD OF DRIVING DISPLAY PANEL AND DISPLAY DEVICE INCLUDING THE DISPLAY PANEL

PRIORITY STATEMENT

This application claims priority under 35 U.S.C. §119 to Korean Patent Application No. 10-2014-0002233, filed on Jan. 8, 2014 in the Korean Intellectual Property Office KIPO, the contents of which are herein incorporated by reference in their entireties.

BACKGROUND

Field

The described technology generally relates to a method of driving a display panel and a display device including the display panel.

Description of the Related Technology

Generally, a liquid crystal display (LCD) includes a first substrate including a pixel electrode, a second substrate including a common electrode and a liquid crystal layer formed between the first and second substrate. An electric field is generated by voltages applied to the pixel electrode and the common electrode. By adjusting the electric field intensity, light transmittance passing through the liquid crystal layer can be adjusted so that a desired image can be displayed.

If a pattern is displayed for a long time, the pattern can remain on the display panel when another image is displayed on the display panel. The remaining pattern is called to an afterimage. A discord between an electric center of a data voltage and a common voltage can cause the afterimage.

In LCDs having a twisted nematic (TN) mode and a vertical alignment (VA) mode, the discordance can occur due to incorrectly tuning the common voltage due to a kickback voltage depending on the position in the display panel.

In addition, in an LCD having a plane to switching (PLS) mode, the V-T curve in a positive polarity and the V-T curve in a negative polarity do not coincide, causing the discordance to naturally occur. Thus, the afterimage problem can be serious in the LCD having the PLS mode compared to the LCD having the TN mode and the VA mode.

SUMMARY OF CERTAIN INVENTIVE ASPECTS

One inventive aspect is a method of driving a display panel capable of improving a display quality by preventing an afterimage.

Another aspect is a display apparatus for performing the above-mentioned method.

Another aspect is a method that includes generating a data voltage based on a gamma reference voltage to output the data voltage to a display panel and periodically and alternately outputting a first common voltage and a second common voltage different from the first common voltage to the display panel.

In an exemplary embodiment, a residual DC voltage can be accumulated at a pixel of the display panel during a first duration during which the first common voltage is outputted to the display panel. The accumulated residual DC voltage can be removed at the pixel of the display panel during a second duration during which the second common voltage is outputted to the display panel.

In an exemplary embodiment, the method can further include determining whether input image data represent a still image or a video image.

In an exemplary embodiment, the first common voltage and the second common voltage can be alternately outputted to the display panel when the input image data represent the still image. The first common voltage can be outputted to the display panel when the input image data represent the video image.

In an exemplary embodiment, the first common voltage and the second common voltage can be alternately outputted to the display panel when the input image data represent the still image. The first common voltage and a third common voltage can be alternately outputted to the display panel when the input image data represent the video image. A difference between the second common voltage and the first common voltage can be greater than a difference between the third common voltage and the first common voltage.

In an exemplary embodiment, the method can further include determining a driving frequency of the display panel based on the input image data. The difference between the second common voltage and the first common voltage and the difference between the third common voltage and the first common voltage can be determined based on the driving frequency of the display panel.

In an exemplary embodiment, the first common voltage and the second common voltage can be alternately outputted to the display panel in a first period when the input image data represent the still image. The first common voltage and the second common voltage can be alternately outputted to the display panel in a second period when the input image data represent the video image. The first period can be less than the second period.

In an exemplary embodiment, the method can further include determining a driving frequency of the display panel based on the input image data. The first period and the second period can be determined based on the driving frequency of the display panel.

In an exemplary embodiment, as a period of alternating the first common voltage and the second common voltage increases, the difference between the second common voltage and the first common voltage can increase. As the period of alternating the first common voltage and the second common voltage decreases, the difference between the second common voltage and the first common voltage can decrease.

In an exemplary embodiment, a difference between the second common voltage and the first common voltage can be equal to or less than about 1% of the first common voltage.

Another aspect is a method that includes periodically and alternately outputting a first data voltage and a second data voltage to a display panel based on a first gamma reference voltage and a second gamma reference voltage, the second gamma reference voltage being different from the first gamma reference voltage for the same grayscale and outputting a common voltage to the display panel.

In an exemplary embodiment, a residual DC voltage can be accumulated at a pixel of the display panel during a first duration during which the first data voltage is outputted to the display panel. The accumulated residual DC voltage can be removed at the pixel of the display panel during a second duration during which the second data voltage is outputted to the display panel.

In an exemplary embodiment, the method can further include determining whether input image data represent a still image or a video image.

In an exemplary embodiment, the first data voltage and the second data voltage can be alternately outputted to the display panel when the input image data represent the still image. The first data voltage can be outputted to the display panel when the input image data represent the video image.

In an exemplary embodiment, the first data voltage and the second data voltage can be alternately outputted to the display panel when the input image data represent the still image. The first data voltage and a third data voltage can be alternately outputted to the display panel when the input image data represent the video image. A difference between the second data voltage and the first data voltage for the same grayscale can be greater than a difference between the third data voltage and the first data voltage for the same grayscale.

In an exemplary embodiment, the first data voltage and the second data voltage can be alternately outputted to the display panel in a first period when the input image data represent the still image. The first data voltage and the second data voltage can be alternately outputted to the display panel in a second period when the input image data represent the video image. The first period can be less than the second period.

Another aspect is a display apparatus that includes a display panel configured to display an image, a data driver configured to generate a data voltage based on a gamma reference voltage to output the data voltage to the display panel and a common voltage generator configured to periodically and alternately output a first common voltage and a second common voltage different from the first common voltage to the display panel.

In an exemplary embodiment, the display apparatus can further include an image determining part configured to determine whether input image data represent a still image or a video image.

In an exemplary embodiment, the common voltage generator can be configured to alternately output the first common voltage and the second common voltage when the input image data represent the still image. The common voltage generator can be configured to alternately output the first common voltage and a third common voltage when the input image data represent the still image. A difference between the second common voltage and the first common voltage can be greater than a difference between the third common voltage and the first common voltage.

In an exemplary embodiment, the common voltage generator can be configured to alternately output the first common voltage and the second common voltage in a first period when the input image data represent the still image. The common voltage generator can be configured to alternately output the first common voltage and the second common voltage in a second period when the input image data represent the still image. The first period can be less than the second period.

Another aspect is a method of driving a display panel, the method comprising providing input image data, generating a gamma reference voltage, generating a data voltage based on the gamma reference voltage and input image data, providing the data voltage to the display panel, determining whether the input image data represents a still image or a video image, generating first and second common voltages, and substantially periodically and alternately providing the first and second common voltages to the display panel repeatedly every first period when the input image data represents the still image.

The above method further comprises accumulating a residual DC voltage at a pixel of the display panel during a first duration during which the first common voltage is provided, and removing the accumulated residual DC voltage during a second duration during which the second common voltage is provided.

The above method further comprises providing only the first common voltage to the display panel when the input image data represents the video image.

The above method further comprises generating a third common voltage, wherein the first and third common voltages are substantially periodically and alternately provided to the display panel when the input image data represents the video image, and wherein the difference between the first and second common voltages is greater than the difference between the first and third common voltages. The above method further comprises determining a driving frequency of the display panel based on the input image data, wherein the difference between the first and second common voltages and the difference between the first and third common voltages are determined based on the driving frequency of the display panel.

The above method further comprises substantially periodically and alternately providing the first and second common voltages to the display panel repeatedly every second period when the input image data represents the video image, wherein the first period is less than the second period. The above method further comprises determining a driving frequency of the display panel based on the input image data, wherein the first and second periods are determined based on the driving frequency of the display panel.

In the above method, as the first period increases, the difference between the first and second common voltages increases, and as the first period decreases, the difference decreases.

In the above method, the difference between the first and second common voltages is substantially equal to or less than about 1% of the first common voltage.

Another aspect is a method of driving a display panel, the method comprising providing input image data, generating first and second gamma reference voltages different from each other, generating a common voltage, providing the common voltage to the display panel, determining whether the input image data represents a still image or a video image, generating first and second data voltages based on the first and second gamma reference voltages, and substantially periodically and alternately providing the first and second data voltages to the display panel repeatedly every first period when the input image data represents the still image.

The above method further comprises accumulating a residual DC voltage at a pixel of the display panel during a first duration during which the first data voltage is provided, and removing the accumulated residual DC voltage during a second duration during which the second data voltage is provided.

The above method further comprises substantially periodically and alternately providing only the first data voltage to the display panel when the input image data represents the video image.

The above method further comprises generating a third data voltage, wherein the first and third data voltages are substantially periodically and alternately provided to the display panel when the input image data represents the video image, and wherein the difference between the first and second data voltages for the same grayscale is greater than the difference between the first and third data voltages for the same grayscale.

The above method further comprises substantially periodically and alternately providing the first and second data voltages to the display panel repeatedly every second period when the input image data represents the video image, wherein the first period is less than the second period.

Another aspect is a display device comprising a display panel, a gamma reference voltage generator, a timing controller, a data driver, and a common voltage generate. The display panel is configured to display an image based on input image data. The gamma reference voltage generator is configured to generate a gamma reference voltage. The timing controller is configured to determine whether the input image data represents a still image or a video image. The data driver is configured to i) generate a data voltage based on the gamma reference voltage and the input image data, and ii) provide the data voltage to the display panel. The common voltage generator is configured to i) generate first and second common voltages different from each other, and ii) substantially periodically and alternately provide the first and second common voltages to the display panel repeatedly every first period when the input image data represents the still image.

In the above display device, the common voltage generator is further configured to i) generate a third common voltage, and ii) substantially periodically and alternately provide the first and the third common voltages to the display panel when the input image data represents the video image, wherein the difference between the first and second common voltages is greater than the difference between the first and third common voltage.

In the above display device, the common voltage generator is further configured to substantially periodically and alternately provide the first and second common voltages to the display panel repeatedly every second period when the input image data represents the video image, wherein the first period is less than the second period.

Another aspect is a display device comprising a display panel, a gamma reference voltage generator, a timing controller, a data driver, and a common voltage generator. The display panel is configured to display an image based on input image data. The gamma reference voltage generator is configured to i) generate first and second reference voltages different from each other, and ii) provide the first and second gamma reference voltages to the display panel. The timing controller is configured to determine whether the input image data represents a still image or a video image. The data driver is configured to i) generate first and second data voltages based on the first and second gamma reference voltages, and ii) substantially periodically and alternately provide the first and second data voltages to the display panel repeatedly every first period when the input image data represents the still image. The common voltage generator is configured to i) generate a common voltage, and ii) provide the common voltage to the display panel.

In the above display device, the common voltage generator is further configured to i) generate a third common voltage, and ii) substantially periodically and alternately provide the first and third common voltages to the display panel when the input image data represents the video image, wherein the difference between the first and second common voltages is greater than the difference between the first and third common voltages.

In the above display device, the common voltage generator is further configured to substantially periodically and alternately provide the first and second common voltages to the display panel repeatedly every second period when the input image data represents the video image, wherein the first period is less than the second period.

According to some embodiments, a level of the common voltage is periodically changed or a level of the data voltage is periodically changed so that the afterimage can be prevented. Thus, a display quality of the display panel can be improved.

DETAILED DESCRIPTION OF CERTAIN INVENTIVE EMBODIMENTS

In this disclosure, the term "substantially" includes the meanings of completely, almost completely or to any significant degree under some applications and in accordance with those skilled in the art.

Hereinafter, the technology will be explained in detail with reference to the accompanying drawings.

Figure 1:
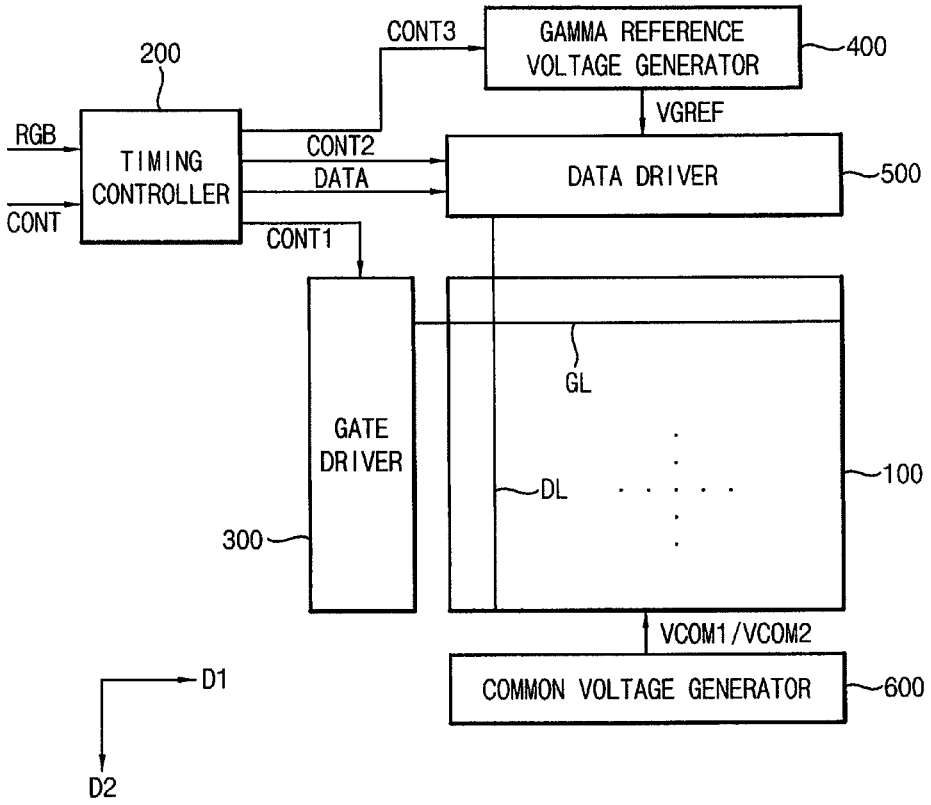
FIG. 1 is a block diagram illustrating a display apparatus according to an exemplary embodiment.

FIG. 1 is a block diagram illustrating a display apparatus according to an exemplary embodiment.

Referring to FIG. 1, the display apparatus includes a display panel 100 and a panel driver. The panel driver includes a timing controller 200, a gate driver 300, a gamma reference voltage generator 400, a data driver 500 and a common voltage generator 600.

The display panel 100 has a display region on which an image is displayed and a peripheral or non-display region adjacent to the display region.

The display panel 100 includes a plurality of gate lines GL, a plurality of data lines DL and a plurality of unit pixels electrically connected to the gate lines GL and the data lines DL. The gate lines GL can extend in a first direction D1 and the data lines DL can extend in a second direction D2 crossing the first direction D1.

Each unit pixel includes a switching element (not shown), a liquid crystal capacitor (not shown) and a storage capacitor (not shown). The liquid crystal capacitor and the storage capacitor are electrically connected to the switching element. The unit pixels can be formed in a matrix form.

The timing controller 200 can receive input image data RGB and an input control signal CONT from an external apparatus (not shown). The input image data RGB can include red image data R, green image data G and blue image data B. The input control signal CONT can include a master clock signal and a data enable signal. The input control signal CONT can further include a vertical synchronizing signal and a horizontal synchronizing signal.

The timing controller 200 can generate a first control signal CONT1, a second control signal CONT2, a third control signal CONT3 and a data signal DATA based on the input image data RGB and the input control signal CONT.

The timing controller 200 can generate the first control signal CONT1 for controlling the gate driver 300 operation based on the input control signal CONT, and output the first control signal CONT1 to the gate driver 300. The first control signal CONT1 can further include a vertical start signal and a gate clock signal.

The timing controller 200 can generate the second control signal CONT2 for controlling the data driver 500 operation based on the input control signal CONT, and output the second control signal CONT2 to the data driver 500. The second control signal CONT2 can include a horizontal start signal and a load signal.

The timing controller 200 can generate the data signal DATA based on the input image data RGB and output the data signal DATA to the data driver 500.

The timing controller 200 can generate the third control signal CONT3 for controlling the gamma reference voltage generator 400 operation based on the input control signal CONT, and output the third control signal CONT3 to the gamma reference voltage generator 400.

The gate driver 300 can generate gate signals driving the gate lines GL in response to the first control signal CONT1. The gate driver 300 can sequentially output the gate signals to the gate lines GL.

The gate driver 300 can be directly mounted on the display panel 100, or can be connected to the display panel 100 as a tape carrier package (TCP) type. Alternatively, the gate driver 300 can be integrated on the display panel 100.

The gamma reference voltage generator 400 can generate a gamma reference voltage VGREF in response to the third control signal CONT3 The gamma reference voltage generator 400 can transmit the gamma reference voltage VGREF to the data driver 500. The gamma reference voltage VGREF has a value corresponding to a level of the data signal DATA.

In an exemplary embodiment, the gamma reference voltage generator 400 can be formed in the timing controller 200, or in the data driver 500.

The data driver 500 can receive the second control signal CONT2 and the data signal DATA from the timing controller 200, and the gamma reference voltages VGREF from the gamma reference voltage generator 400. The data driver 500 can convert the data signal DATA into analog data voltages using the gamma reference voltages VGREF. The data driver 500 can output the data voltages to the data lines DL.

The data driver 500 can be directly mounted on the display panel 100, or be connected to the display panel 100 in a TCP type. Alternatively, the data driver 500 can be integrated on the display panel 100.

The common voltage generator 600 can generate a first common voltage VCOM1 and a second common voltage VCOM2 different from the first common voltage VCOM1. The common voltage generator 600 can output the first and second common voltages VCOM1 and VCOM2 to the display panel 100. The common voltage generator 600 can periodically and alternately output the first and second common voltages VCOM1 and VCOM2.

Figure 2:
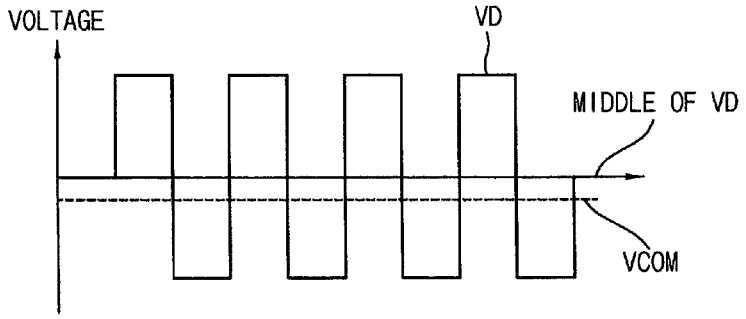
FIG. 2 is a waveform diagram illustrating a data voltage and a common voltage to explain a residual DC voltage accumulated in a display panel.
Figure 3A:
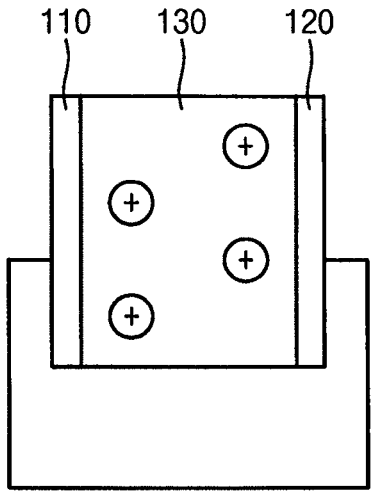
FIGS. 3A to 3C are conceptual diagrams to explain the residual DC voltage accumulated in the display panel.
Figure 3B:
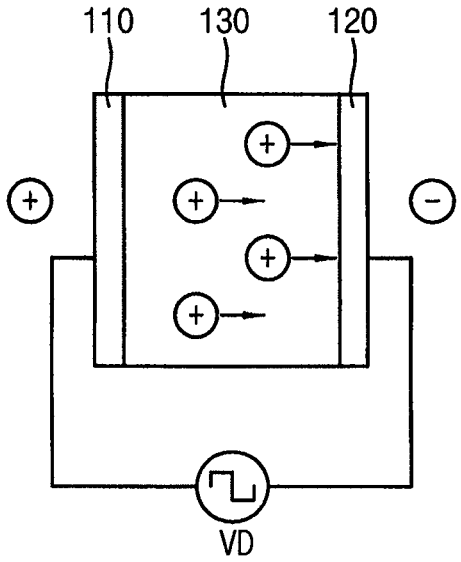
Figure 3C:
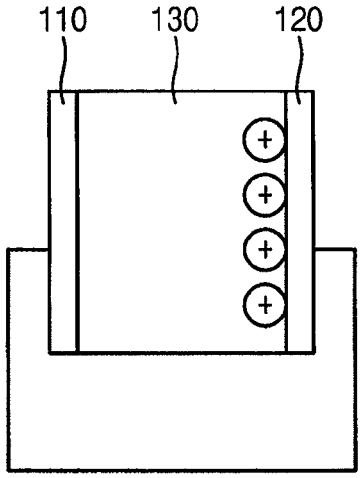
Figure 4:
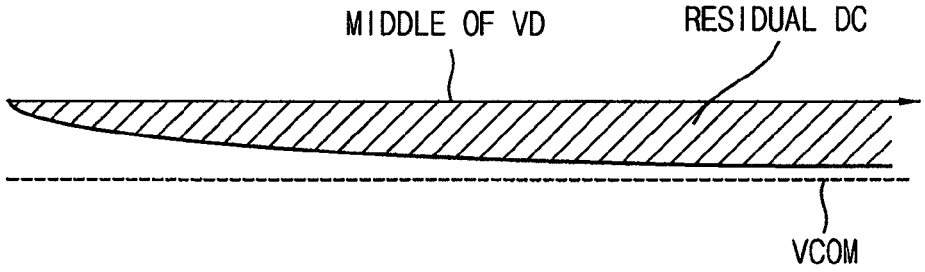
FIG. 4 is a waveform diagram illustrating the residual DC voltage accumulated in the display panel.

FIG. 2 is a waveform diagram illustrating a data voltage and a common voltage to explain a residual DC voltage accumulated in the display panel 100. FIGS. 3A to 3C are conceptual diagrams to explain the residual DC voltage accumulated in the display panel 100. FIG. 4 is a waveform diagram illustrating the residual DC voltage accumulated in the display panel 100.

In FIGS. 2 to 4, when a common voltage VCOM having a substantially uniform level is applied to the display panel 100 and the electric center or middle or average of the data voltage VD is not equal to the common voltage VCOM is supposed.

Referring to FIGS. 1 to 4, the display panel 100 includes a first substrate 110 including a pixel electrode, a second substrate 120 and a liquid crystal layer 130 formed between the first substrate 110 and the second substrate 120.

The data voltage VD can be applied to the pixel electrode of the first substrate 110. The common voltage VCOM can be applied to the common electrode of the second substrate 120.

In some embodiments, the electric center of the data voltage VD is not equal to the common voltage VCOM. The reasons for the discordance of the electric center of the data voltage VD and the common voltage VCOM can vary, for example, a manufacturing process variation or discordance between a V-T curve in a positive polarity and V-T curve in a negative polarity. In addition, the reason can be deviation of a kickback voltage according to positions in the display panel 100.

In FIG. 3A, voltages are not applied to the first substrate 110 and the second substrate 120. The positive holes (+) are substantially uniformly distributed in the liquid crystal layer 130.

In FIG. 3B, the data voltage VD is applied to the first substrate 110 and the common voltage VCOM is applied to the second substrate 120. The electric center of the data voltage VD is higher than the common voltage VCOM so that the first substrate has a positive average voltage and the second substrate has a negative average voltage. Thus, the positive holes (+) are displaced toward the second substrate 120. When the data voltage VD is applied to the first substrate 110 for a long time, the positive holes (+) are completely displaced to the second substrate 120.

In FIG. 3C, voltages are no longer applied to the first substrate 110 and the second substrate 120 after the applications in FIG. 2B. However, the positive holes (+) are already completely displaced to the second substrate 120 due to the data voltage VD in FIG. 3B. Thus, a residual DC voltage can be generated in a pixel of the display panel 100.

As shown in FIG. 4, the residual DC voltage is continuously accumulated in the pixel of the display panel 100 as time passes. Thus, the residual DC voltage is saturated in the pixel. Due to the residual DC voltage, a positive data voltage applied to the pixel can represent a luminance less than a corresponding grayscale.

Levels of the residual DC voltages can vary according to the pixels. For example, when a relatively high grayscale voltage is applied to the pixel, much residual DC voltage can be accumulated at the pixel. In contrast, when a relatively low grayscale voltage is applied to the pixel, little residual DC voltage can be accumulated at the pixel.

When a pixel displays white, the residual DC voltage accumulated at the pixel is very high. In contrast, when the pixel displays black, the residual DC voltage accumulated at the pixel is very low. Thus, when a grayscale image is applied after a checker board pattern alternately including white and black is applied to the display panel 100 for a long time, a pixel displaying black represents a luminance different from that of a pixel displaying white. Therefore, the afterimage is generated due to the difference of the luminances between the pixels.

Figure 5:
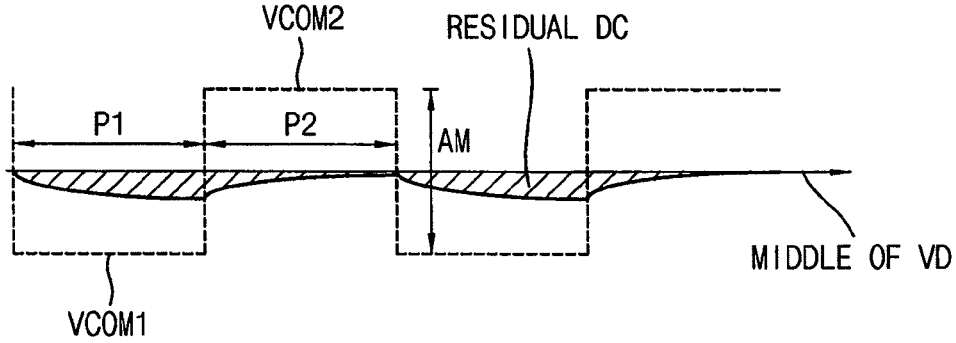
FIG. 5 is a waveform diagram illustrating a data voltage and a common voltage applied to the display panel of FIG. 1.
Figure 6A:
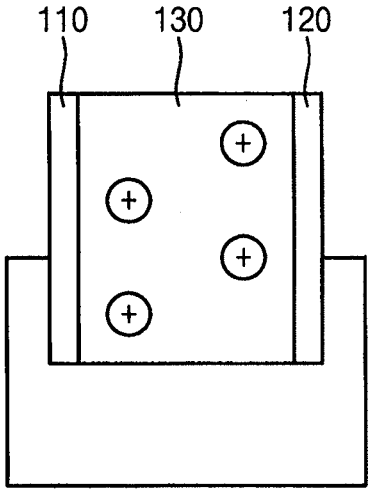
FIGS. 6A to 6C are conceptual diagrams illustrating displacement of positive holes in the display panel of FIG. 1 during a first duration.
Figure 6B:
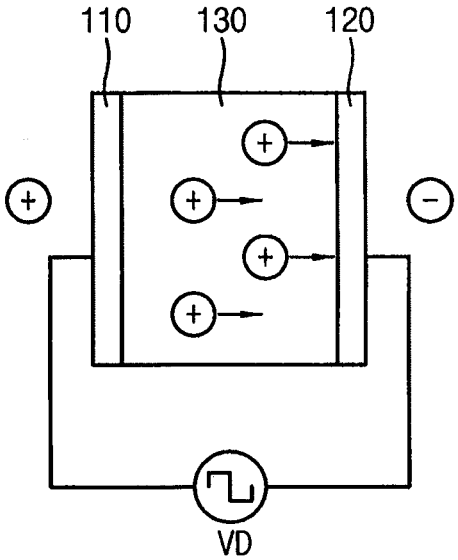
Figure 6C:
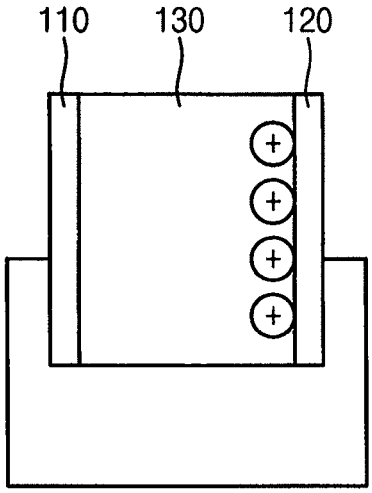
Figure 7A:
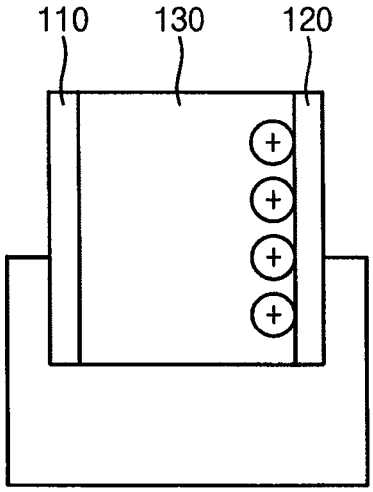
FIGS. 7A to 7C are conceptual diagrams illustrating displacement of positive holes in the display panel of FIG. 1 during a second duration.
Figure 7B:
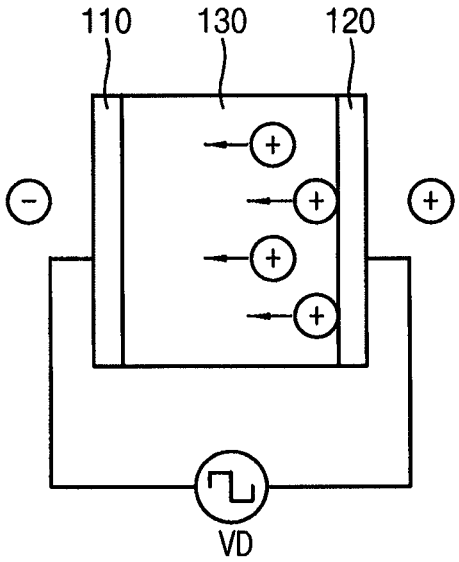
Figure 7C:
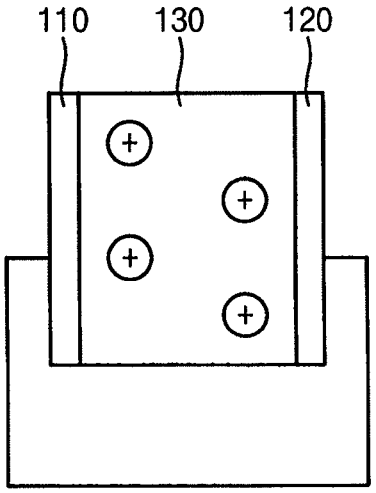

FIG. 5 is a waveform diagram illustrating the data voltage VD and the common voltage VCOM applied to the display panel 100. FIGS. 6A to 6C are conceptual diagrams illustrating displacement of positive holes in the display panel 100 during a first duration P1. FIGS. 7A to 7C are conceptual diagrams illustrating displacement of positive holes in the display panel 100 of FIG. 1 during a second duration P2.

Referring to FIGS. 1, 5, 6A to 6C and 7A to 7C, the common voltage generator 600 alternately outputs a first common voltage VCOM1 and a second common voltage VCOM2. The common voltage generator 600 can periodically and alternately output the first and second common voltages VCOM1 and VCOM2.

During the first duration P1, the common voltage generator 600 outputs the first common voltage VCOM1 to the display panel 100. When the first common voltage VCOM1 is less than the electric center of the data voltage VD, the residual DC voltage can be accumulated at the pixel of the display panel 100.

In FIG. 6A, voltages are not applied to the first substrate 110 and the second substrate 120. The positive holes (+) are substantially uniformly distributed in the liquid crystal layer 130.

In FIG. 6B, the data voltage VD is applied to the first substrate 110 and the first common voltage VCOM1 is applied to the second substrate 120. The electric center of the data voltage VD is higher than the first common voltage VCOM1 so that the first substrate has a positive average voltage and the second substrate has a negative average voltage. Thus, the positive holes (+) are displaced toward the second substrate 120.

In FIG. 6C, voltages are not applied to the first substrate 110 and the second substrate 120 after the applications of FIG. 6B. However, the positive holes (+) are displaced to the second substrate 120 due to the data voltage in FIG. 6B. Thus, a residual DC voltage can be accumulated in the pixel.

During the second duration P2, the common voltage generator 600 outputs the second common voltage VCOM2 to the display panel 100. When the second common voltage VCOM2 is greater than the electric center of the data voltage VD, the residual DC voltage can be removed at the pixel of the display panel 100.

In FIG. 7A, voltages are not applied to the first substrate 110 and the second substrate 120. The state of the liquid crystal layer 130 in FIG. 7A is substantially the same as that of the liquid crystal layer 130 in FIG. 6C.

In FIG. 7B, the data voltage VD is applied to the first substrate 110 and the second common voltage VCOM2 is applied to the second substrate 120. The electric center of the data voltage VD is less than the second common voltage VCOM2 so that the first substrate has a negative average voltage and the second substrate has a positive average voltage. Thus, the positive holes (+) come back toward the first substrate 110.

In FIG. 7C, voltages are not applied to the first substrate 110 and the second substrate 120. The positive holes (+) are substantially uniformly distributed in the liquid crystal layer 130 due to the data voltage VD in FIG. 7B. Thus, the residual DC voltage can be removed at the pixel.

A period of alternating the first and the first and second common voltages VCOM1 and VCOM2 can be represented as a sum of the first duration P1 and the second duration P2. For example, lengths of the first and second durations P1 and P2 can be substantially the same. The period can be several seconds or several minutes.

In some embodiments, the period is not synchronized with an image of the display panel 100.

The period can be set to prevent accumulation of the residual DC voltage in the pixel. As the period is shorter, accumulation of the residual DC voltage in the pixel can be prevented better. However, when the period is excessively short, power consumption of the display apparatus can increase.

The first common voltage VCOM1 can be a normal common voltage of the display panel 100. The second common voltage VCOM2 can be a compensating common voltage to compensate the residual DC voltage of the display panel 100.

Although the second common voltage VCOM2 is greater than the first common voltage VCOM1 in the present exemplary embodiment, the described technology is not limited thereto.

When the electric center of the data voltage VD is determined to be greater than the first common voltage VCOM1, the second common voltage VCOM2 can be greater than the first common voltage VCOM1. When the electric center of the data voltage VD is determined to be less than the first common voltage VCOM1, the second common voltage VCOM2 can be less than the first common voltage VCOM1.

A difference AM between the first and second common voltages VCOM1 and VCOM2 can be set to prevent the accumulation of the residual DC voltage in the pixel. When the difference AM is large, the accumulation can be prevented better. However, in some embodiments, when the difference AM is excessively large, the display panel 100 does not display the grayscale accurately and a flickering can be perceived by the user.

The difference AM can be substantially equal to or less than about 1%. For example, when the first common voltage VCOM1 is about 3.3V, the difference AM can be substantially equal to or less than about 30 mV.

As the period of alternating the first and second common voltages VCOM1 and VCOM2 increases, the difference AM can increase.

In contrast, as the period decreases, the difference AM can decrease.

Although the first common voltage VCOM1 is less than the electric center of the data voltage VD and the second common voltage VCOM2 is greater than the electric center of the data voltage VD in the present exemplary embodiment, the described technology is not limited thereto. For example, when the first common voltage VCOM1 is less than the electric center of the data voltage VD, the second common voltage VCOM2 is also less than the electric center of the data voltage VD and the common voltage swings between the first and second common voltages VCOM1 and VCOM2, the saturation of the residual DC voltage can be prevented so that the afterimage decreases.

In some embodiments, the common voltage generator 600 periodically and alternately outputs the first and second common voltages VCOM1 and VCOM2 so that the accumulation can be prevented. Thus, the afterimage can be prevented so that the display quality of the display panel 100 is improved.

Figure 8:
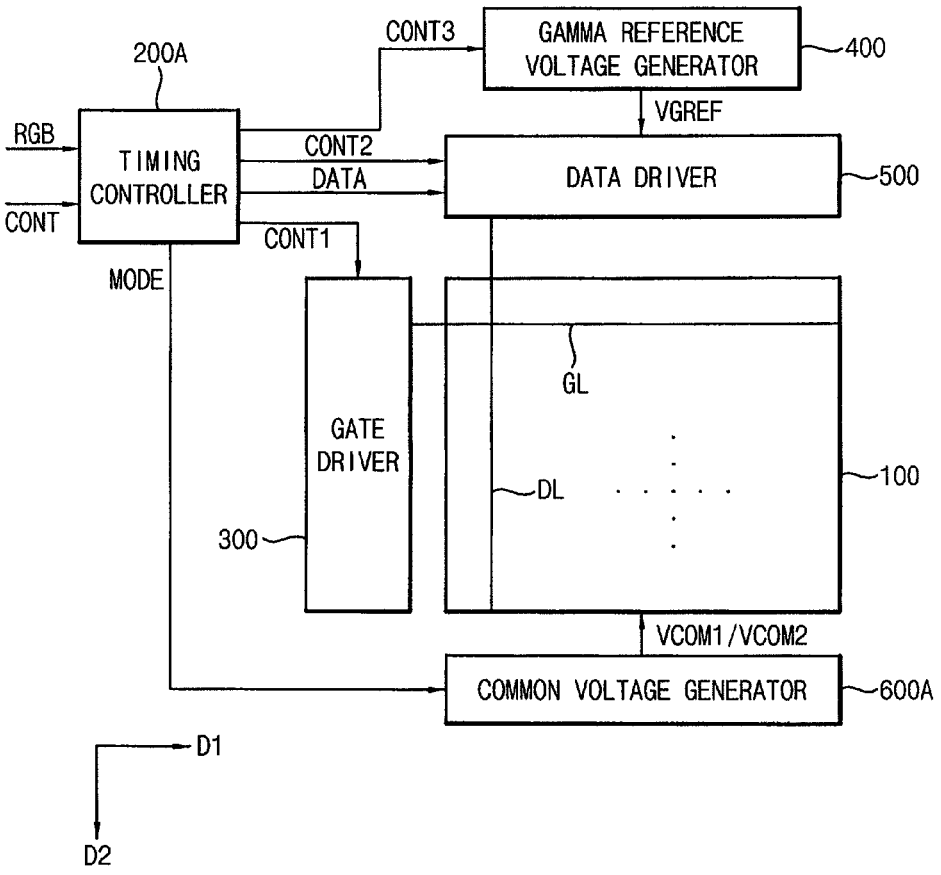
FIG. 8 is a block diagram illustrating a display apparatus according to an exemplary embodiment.
Figure 9:
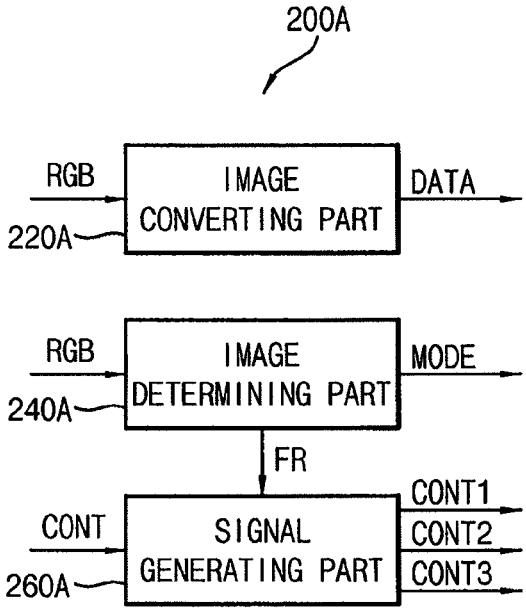
FIG. 9 is a block diagram illustrating a timing controller of FIG. 8.
Figure 10:
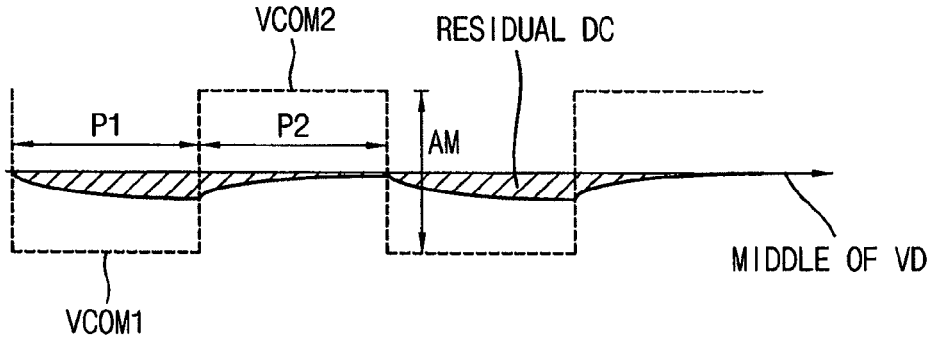
FIG. 10 is a waveform diagram illustrating a data voltage and a common voltage applied to the display panel of FIG. 8.

FIG. 8 is a block diagram illustrating a display apparatus according to an exemplary embodiment. FIG. 9 is a block diagram illustrating a timing controller 200A of FIG. 8. FIG. 10 is a waveform diagram illustrating a data voltage and a common voltage applied to a display panel 100 of FIG. 8.

Referring to FIG. 8, the display apparatus is substantially the same as the display apparatus of the previous exemplary embodiment explained referring to FIGS. 1 to 7C except that the timing controller 200A includes an image determining part 240A and a common voltage generating part 600A. The common voltage generating part 600A is operated according to a mode signal of the image determining part 240A. Thus, the same reference numerals will be used to refer to the same or like parts as those described in the previous exemplary embodiment of FIGS. 1 to 7C and any repetitive explanation concerning the above elements will be omitted.

Referring to FIGS. 8 to 10, the display apparatus includes the display panel 100 and a panel driver. The panel driver includes the timing controller 200A, the gate driver 300, the gamma reference voltage generator 400, the data driver 500 and the common voltage generator 600A.

The timing controller 200A can include an image converting part 220A and the image determining part 240A and a signal generating part 260A.

The image converting part 220A can compensate grayscale data of the input image data RGB and rearrange the input image data RGB to generate the data signal DATA corresponding to a data type of the data driver 500. The data signal DATA can have a digital type. The image converting part 220A can output the data signal DATA to the data driver 500.

For example, the image converting part 220A can include an adaptive color correcting part (not shown) and a dynamic capacitance compensating part (not shown).

The adaptive color correcting part can receive the grayscale data of the input image data RGB, and perform an adaptive color correction (ACC). The adaptive color correcting part can compensate the grayscale data using a gamma curve.

The dynamic capacitance compensating part can perform a dynamic capacitance compensation ("DCC"), which compensates the grayscale data of present frame data using previous frame data and the present frame data.

The image determining part 240A can determine whether the input image data RGB represents a still image or a video image. The image determining part 240A can output a mode signal MODE which indicates whether the input image data RGB represents a still image or a video image to the common voltage generator 600A.

The image determining part 240A can determine a driving frequency FR of the display panel 100 based on the input image data RGB. For example, when the input image data RGB represents a still image, the display panel 100 can be driven in a relatively low driving frequency. In contrast, when the input image data RGB represents a video image, the display panel 100 can be driven in a relatively high driving frequency.

The signal generating part 260A can the input control signal CONT. The signal generating part 260A can generate the first control signal CONT1 to control a driving timing of the gate driver 300 based on the input control signal CONT and the driving frequency FR. The signal generating part 260A can generate the second control signal CONT2 to control a driving timing of the data driver 500 based on the input control signal CONT and the driving frequency FR. The signal generating part 260A can generate the third control signal CONT3 to control a driving timing of the gamma reference voltage generator 400 based on the input control signal CONT and the driving frequency FR.

The signal generating part 260A can output the first control signal CONT1 to the gate driver 300. The signal generating part 260A can output the second control signal CONT2 to the data driver 500. The signal generating part 260A can output the third control signal CONT3 to the gamma reference voltage generator 400.

The common voltage generator 600A can generate the first common voltage VCOM1 and the second common voltage VCOM2 different from the first common voltage VCOM1. The common voltage generator 600A can output the first and second common voltages VCOM1 and VCOM2 to the display panel 100. The common voltage generator 600 can periodically and alternately output the first and second common voltages VCOM1 and VCOM2.

The common voltage generator 600A can generate the common voltage based on the mode signal MODE. When the input image data RGB represents a still image, the common voltage generator 600A can alternately output the first and second common voltages VCOM1 and VCOM2. When the input image data RGB represents a video image, the common voltage generator 600A can output the first common voltage VCOM1.

When the input image data RGB represents a still image, a possibility of accumulation of the residual DC voltage increases compared to when the input image data RGB represents a video image. Thus, for a still image, the compensating common voltage VCOM2 can be outputted.

Alternatively, when the input image data RGB represents a still image, the common voltage generator 600A can alternately output the first and second common voltages VCOM1 and VCOM2. When the input image data RGB represents a video image, the common voltage generator 600A can alternately output the first common voltage VCOM1 and a third common voltage. The difference between the first and second common voltages VCOM1 and VCOM2 can be greater than the difference between the third common voltage and the first common voltage VCOM1.

When the input image data RGB represents a still image, the possibility of accumulation of the residual DC voltage increases compared to when the input image data RGB represents a video image. Thus, when the input image data RGB represents a still image, the compensating common voltage VCOM2 can be greater than the third common voltage, which is the compensating common voltage when the input image data RGB represents a video image.

Alternatively, when the input image data RGB represents a still image, the common voltage generator 600A can alternately output the first and second common voltage VCOM1 and VCOM2 in a first period. When the input image data RGB represents a video image, the common voltage generator 600A can alternately output the first and second common voltages VCOM1 and VCOM2 in a second period. The first period can be shorter than the second period.

When the input image data RGB represents a still image, the possibility of accumulation of the residual DC voltage increases compared to when the input image data RGB represents a video image. Thus, when the input image data RGB represents a still image, the compensating common voltage VCOM2 can be applied to the display panel 100 in a relatively shorter period compared to when the input image data RGB represents a video image.

In some embodiments, the common voltage generator 600A periodically and alternately can output the first and second common voltages VCOM1 and VCOM2 so that the accumulation can be prevented when the input image data RGB represents a still image. Thus, the afterimage can be prevented so that the display quality of the display panel 100 can be improved.

Figure 11:
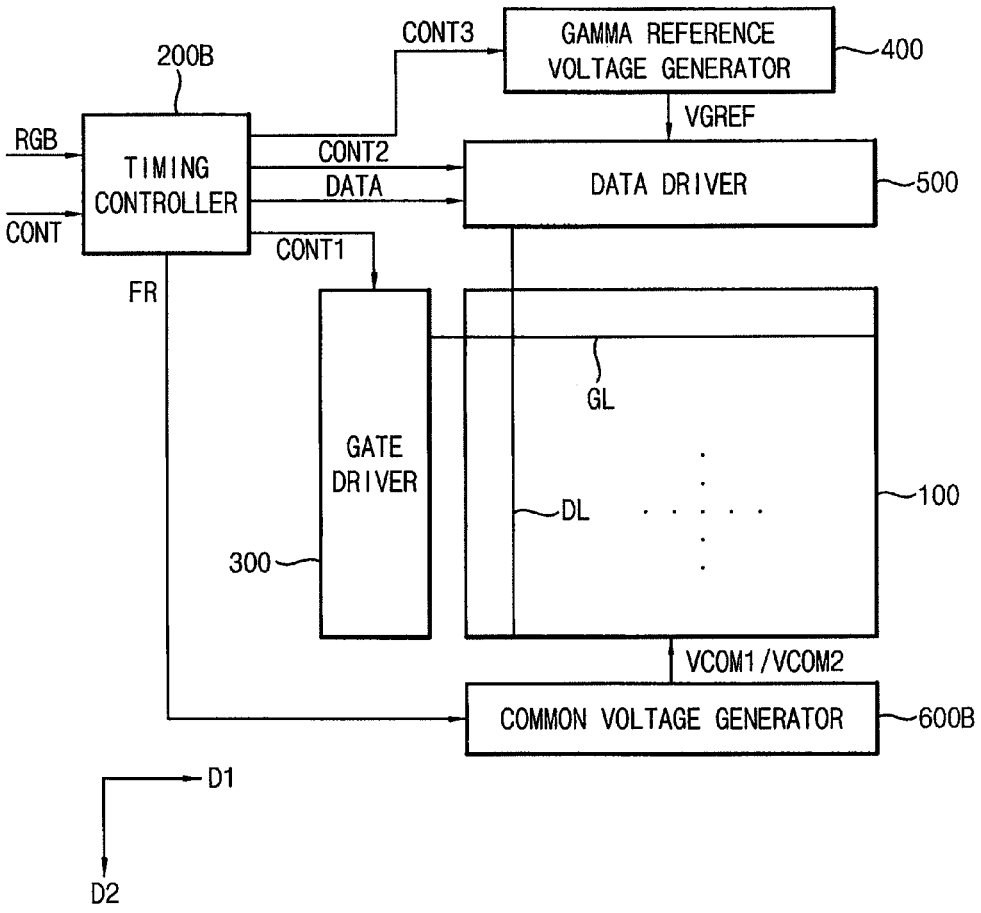
FIG. 11 is a block diagram illustrating a display apparatus according to an exemplary embodiment.
Figure 12:
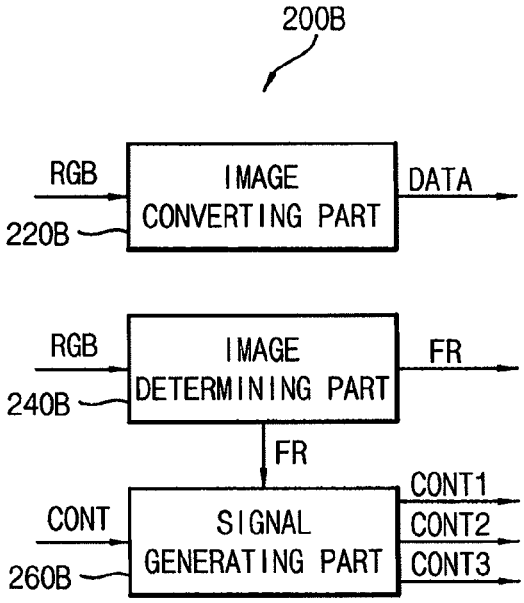
FIG. 12 is a block diagram illustrating the timing controller of FIG. 11.
Figure 13:
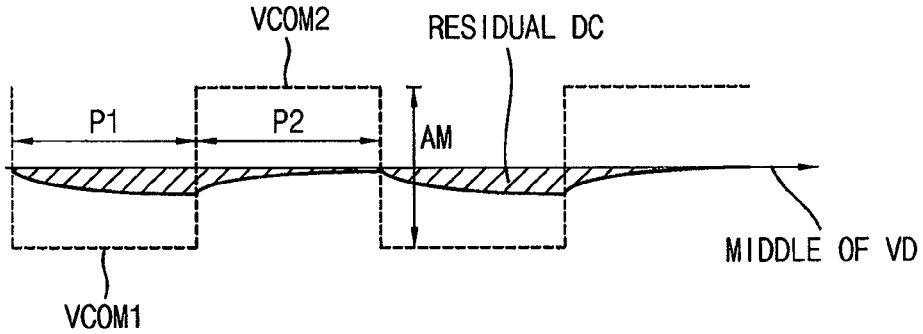
FIG. 13 is a waveform diagram illustrating a data voltage and a common voltage applied to the display panel of FIG. 11.

FIG. 11 is a block diagram illustrating a display apparatus according to an exemplary embodiment. FIG. 12 is a block diagram illustrating a timing controller 200B of FIG. 11. FIG. 13 is a waveform diagram illustrating the data voltage and the common voltage applied to a display panel 100 of FIG. 11.

Referring to FIG. 11, the display apparatus is substantially the same as the display apparatus of the embodiments explained referring to FIGS. 1 to 7C except that the timing controller 200B includes an image determining part 240B and a common voltage generating part 600B. The common voltage generating part 600B is operated according to a driving frequency signal FR of the image determining part 240B. Thus, the same reference numerals will be used to refer to the same or like parts as those described in the previous exemplary embodiment of FIGS. 1 to 7C and any repetitive explanation concerning the above elements will be omitted.

Referring to FIGS. 11 to 13, the display apparatus includes the display panel 100 and a panel driver. The panel driver includes the timing controller 200B, the gate driver 300, the gamma reference voltage generator 400, the data driver 500 and the common voltage generator 600B.

The timing controller 200B includes an image converting part 220B and an image determining part 240B and a signal generating part 260B.

The image converting part 220B can compensate gray-scale data of the input image data RGB and rearrange the input image data RGB to generate the data signal DATA corresponding to a data type of the data driver 500. The data signal DATA can have a digital type. The image converting part 220B can output the data signal DATA to the data driver 500.

For example, the image converting part 220B can include an adaptive color correcting part (not shown) and a dynamic capacitance compensating part (not shown).

The image determining part 240B can determine the driving frequency FR based on the input image data RGB. For example, when the input image data RGB represents a still image, the display panel 100 can be driven in a relatively low driving frequency. In contrast, when the input image data RGB represents a video image, the display panel 100 can be driven in a relatively high driving frequency. The image determining part 240B can output the driving frequency signal FR to the common voltage generator 600B.

The driving frequency FR can have two levels corresponding to the relatively high frequency and the relatively low frequency. Alternatively, the driving frequency FR can have more than two levels depending on the state of the input image data RGB.

The signal generating part 260B can receive the input control signal CONT. The signal generating part 260B can generate the first control signal CONT1 to control a driving timing of the gate driver 300 based on the input control signal CONT and the driving frequency FR. The signal generating part 260B can generate the second control signal CONT2 to control a driving timing of the data driver 500 based on the input control signal CONT and the driving frequency FR. The signal generating part 260B can generate the third control signal CONT3 to control a driving timing of the gamma reference voltage generator 400 based on the input control signal CONT and the driving frequency FR.

The signal generating part 260B can output the first control signal CONT1 to the gate driver 300. The signal generating part 260B can output the second control signal CONT2 to the data driver 500. The signal generating part 260B can output the third control signal CONT3 to the gamma reference voltage generator 400.

The common voltage generator 600B can output first common and second common voltages VCOM1 and VCOM2 different from the first common voltage VCOM1. The common voltage generator 600B outputs the first and second common voltages VCOM1 and VCOM2 to the display panel 100. The common voltage generator 600 can periodically and alternately output the first and second common voltages VCOM1 and VCOM2.

The common voltage generator 600B can generate the common voltage based on the driving frequency signal FR. The common voltage generator 600B can determine the difference AM between the first and second common voltages VCOM1 and VCOM2 based on the driving frequency signal FR.

For example, as the driving frequency FR increases, the possibility of accumulation of the residual DC voltage decreases. Thus, as the driving frequency FR increases, the difference AM can decrease.

In contrast, as the driving frequency FR decreases, the possibility of the accumulation increases. Thus, as the driving frequency FR decreases, the difference AM can increase.

The common voltage generator 600B can determine the period of alternating the first and second common voltages VCOM1 and VCOM2 based on the driving frequency FR.

For example, as the driving frequency FR increases, the possibility of the accumulation decreases. Thus, as the driving frequency FR increases, the period of alternating the first and second common voltages VCOM1 and VCOM2 can increase.

In contrast, as the driving frequency FR decreases, the possibility of the accumulation increases. Thus, as the driving frequency FR decreases, the period of alternating the first and second common voltages VCOM1 and VCOM2 can decrease.

In some embodiments, the common voltage generator 600 periodically and alternately can output the first and second common voltages VCOM1 and VCOM2 so that the accumulation can be prevented. Thus, the afterimage can be prevented so that the display quality can be improved.

Figure 14:
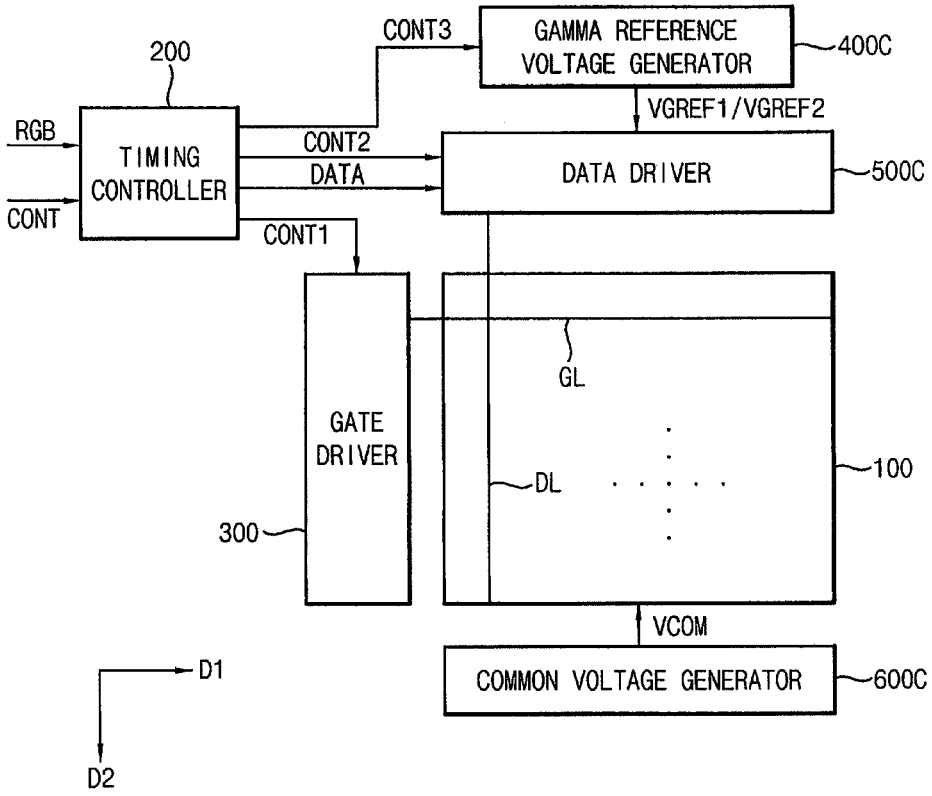
FIG. 14 is a block diagram illustrating a display apparatus according to an exemplary embodiment.
Figure 15:
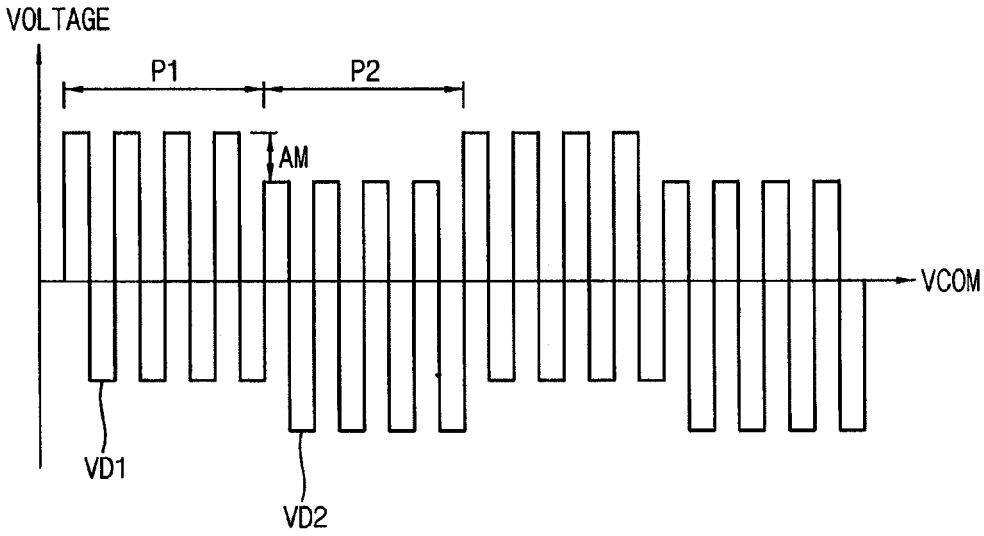
FIG. 15 is a waveform diagram illustrating a data voltage and a common voltage applied to the display panel of FIG. 14.

FIG. 14 is a block diagram illustrating a display apparatus according to an exemplary embodiment. FIG. 15 is a waveform diagram illustrating a data voltage and a common voltage applied to the display panel 100 of FIG. 14.

Referring to FIG. 14, the display apparatus is substantially the same as the display apparatus of the previous exemplary embodiment explained referring to FIGS. 1 to 7C except that a first data voltage and a second data voltage are alternately outputted so as to prevent the afterimage instead of alternately outputting the first common voltage and the second common voltage. Thus, the same reference numerals will be used to refer to the same or like parts as those described in the previous exemplary embodiment of FIGS. 1 to 7C and any repetitive explanation concerning the above elements will be omitted.

Referring to FIGS. 14 and 15, the display apparatus includes the display panel 100 and a panel driver. The panel driver includes the timing controller 200, the gate driver 300, a gamma reference voltage generator 400C, a data driver 500C and a common voltage generator 600C.

The gamma reference voltage generator 400C can generate first and second gamma reference voltages VGREF1 and VGREF2. The second gamma reference voltage VGREF2 has a different level than the first gamma reference voltage VGREF1 for the same grayscale. The gamma reference voltage generator 400C can provide the first and second gamma reference voltages VGREF1 and VGREF2 to the data driver 500C.

The data driver 500C can generate a first data voltage VD1 based on the first gamma reference voltage VGREF1. The data driver 500C can output the first data voltage VD1 to the display panel 100. The data driver 500C can generate a second data voltage VD2 based on the second gamma reference voltage VGREF2. The data driver 500C can output the second data voltage VD2 to the display panel 100.

In some embodiments, the common voltage generator 600C provides a common voltage having a substantially uniform level to the display panel 100.

During the first duration P1, the gamma reference voltage generator 400C can generate the first gamma reference voltage VGREF1. The data driver 500C can generate the first data voltage VD1 with respect to the data signal DATA based on the first gamma reference voltage VGREF1 so as to output the first data voltage VD1 to the display panel 100.

An electric center of the first data voltage VD1 can be greater than the common voltage VCOM. Accordingly, during the first duration P1, the residual DC voltage can be accumulated at the pixel.

During the second duration P2, the gamma reference voltage generator 400C can generate the second gamma reference voltage VGREF2. The data driver 500C can generate the second data voltage VD2 with respect to the data signal DATA based on the second gamma reference voltage VGREF2 so as to output the second data voltage VD2 to the display panel 100.

An electric center of the second data voltage VD2 can be less than the common voltage VCOM. Accordingly, during the second duration P2, the residual DC voltage can be removed at the pixel.

The exemplary embodiment explained referring to FIGS. 8 to 10 and the exemplary embodiment explained referring to FIGS. 11 to 13 can be employed to the present exemplary embodiment which adjusts the level of the data voltage instead of the common voltage.

The timing controller 200 can include an image determining part, which determines whether the input image data RGB represents a still image or a video image, and a driving frequency of the display panel 100.

The gamma reference voltage generator 400C can generate the gamma reference voltage based on the mode signal MODE. When the input image data RGB represents a still image, the gamma reference voltage generator 400C can alternately generate the first and second gamma reference voltages VGREF1 and VGREF2. When the input image data RGB represents a video image, the gamma reference voltage generator 400C can generate the first gamma reference voltage VGREF1.

Thus, when the input image data RGB represents a still image, the first and second data voltages VD1 and VD2 are alternately outputted to the display panel 100. When the input image data RGB represents a video image, the first data voltage VD1 is output to the display panel 100.

Alternatively, when the input image data RGB represents a still image, the gamma reference voltage generator 400C can alternately generate the first and second gamma reference voltages VGREF1 and VGREF2. When the input image data RGB represents a video image, the gamma reference voltage generator 400C can alternately generate the first gamma reference voltage VGREF1 and a third gamma reference voltage.

Thus, when the input image data RGB represents a still image, the first and second data voltages VD1 and VD2 are alternately output to the display panel 100. When the input image data RGB represents a video image, the first data voltage VD1 and a third data voltage VD3 are alternately output to the display panel 100. A difference AM between the first and second data voltages VD1 and VD2 for the same grayscale can be greater than a difference between the third data voltage and the first data voltage VD1 for the same grayscale.

Alternatively, when the input image data RGB represents a still image, the gamma reference voltage generator 400C can alternately generate the first and second gamma reference voltages VGREF1 and VGREF2 in a first period. When the input image data RGB represents a video image, the gamma reference voltage generator 400C can alternately generate the first and second gamma reference voltages VGREF1 and VGREF2 in a second period.

Thus, when the input image data RGB represents a still image, the first and second data voltages VD1 and VD2 are alternately output to the display panel 100 in the first period. When the input image, data RGB represents a video image, the first and second data voltages VD1 and VD2 are alternately output to the display panel 100 in the second period. The first period can be less than the second period.

In addition, the gamma reference voltage generator 400C can generate the gamma reference voltage based on the driving frequency signal FR. The gamma reference voltage generator 400C can determine the difference between the first and second gamma reference voltages VGREF1 and VGREF2 based on the driving frequency signal FR. Accordingly, the difference AM between the first and second data voltages VD1 and VD2 can be determined.

In addition, the gamma reference voltage generator 400C can determine the period of alternating the first and second gamma reference voltages VGREF1 and VGREF2 based on the driving frequency signal FR. Accordingly, the period of alternating the first and second data voltages VD1 and VD2 can be determined.

In some embodiments, the gamma reference voltage generator 400C periodically and alternately can generate the first and second gamma reference voltages VGREF1 and VGREF2 and the data driver 500C periodically and alternately can output the first and second data voltages VD1 and VD2 to the display panel 100 so that the accumulation can be prevented. Thus, the afterimage can be prevented so that the display quality can be improved.

Figure 16:
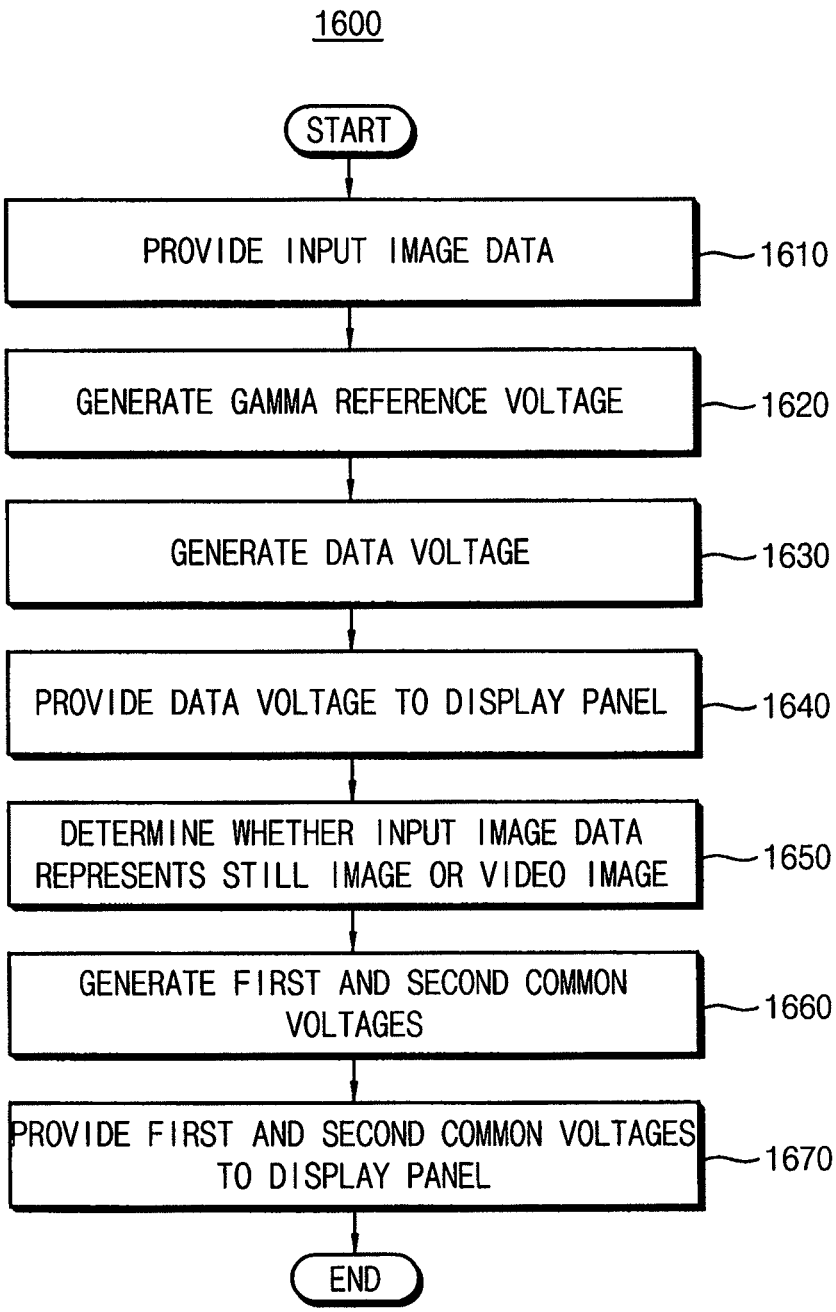
FIG. 16 is a flowchart showing an exemplary operation of driving a display panel.

FIG. 16 is a flowchart showing an exemplary operation or procedure 1600 for driving a display panel according to one embodiment. In state 1610, the input image data is provided to the timing controller 200. In state 1620, a gamma reference voltage is generated by the gamma reference voltage generator 400. In state 1630, a data voltage is generated based on the gamma reference voltage and the input image data. In state 1640, the data voltage is provided to the display panel. In state 1650, the image determining module 240A determines whether the input image data represents the still image or the video image. In state 1660, first and second common voltages generated. In state 1670, the first and second common voltages are substantially periodically and alternately provided to the display panel 100 repeatedly every first period when the input image data represents the still image.

Figure 17:
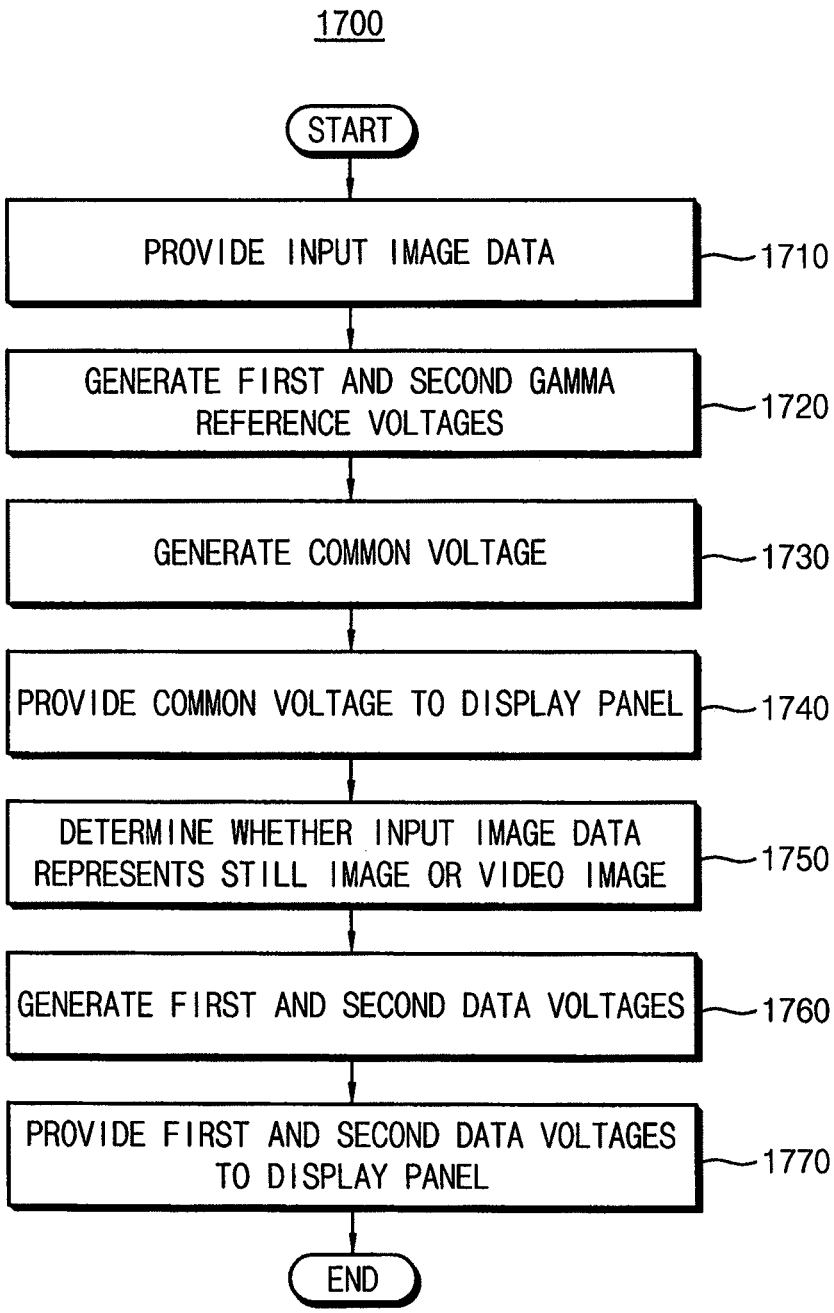
FIG. 17 is a flowchart showing another exemplary operation of driving a display panel.

FIG. 17 is a flowchart showing another exemplary operation or procedure 1700 for driving a display panel according to one embodiment. In state 1710, an input image data is provided to the display device. In state 1720, first and second gamma reference voltages VGREF different from each other are generated. In state 1730, a common voltage is generated. In state 1740, the common voltage is provided to the display panel 100. In state 1750, the image determining module 240A determines whether the input image data is represents the still image or the video image. In state 1760, first and second data voltages based on the first and second gamma reference voltages are generated. In state 1770, the first and second data voltages are substantially periodically and alternately provided to the display panel repeatedly every first period when the image data represents the still image.

In some embodiments, the FIG. 16 or 17 procedure is implemented in a conventional programming language, such as C or C++ or another suitable programming language. The program can be stored on a computer accessible storage medium of the display device, for example, a memory (not shown) of the display device. In certain embodiments, the storage medium includes a random access memory (RAM), hard disks, floppy disks, digital video devices, compact discs, video discs, and/or other optical storage mediums, etc. The program can be stored in the processor. The processor can have a configuration based on, for example, i) an advanced RISC machine (ARM) microcontroller and ii) Intel Corporation's microprocessors (e.g., the Pentium family microprocessors). In certain embodiments, the processor is implemented with a variety of computer platforms using a single chip or multichip microprocessors, digital signal processors, embedded microprocessors, microcontrollers, etc. In another embodiment, the processor is implemented with a wide range of operating systems such as Unix, Linux, Microsoft DOS, Microsoft Windows 7/Vista/2000/9x/ME/XP, Macintosh OS, OS/2, Android, iOS and the like. In another embodiment, at least part of the procedure can be implemented with embedded software. Depending on the embodiment, additional states can be added, others removed, or the order of the states changed in FIGS. 16 and 17.

According to some embodiments as explained above, the afterimage due to the accumulation of the residual DC voltage is prevented so that the display quality of the display apparatus can be improved.

The foregoing is illustrative of the inventive concept and is not to be construed as limiting thereof. Although a few exemplary embodiments have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A method of driving a display panel, the method comprising:

providing input image data;

generating a gamma reference voltage;

generating a data voltage based on the gamma reference voltage and input image data;

providing the data voltage to the display panel;

determining whether the input image data represents a still image or a video image;

generating first and second common voltages that are different from each other; and substantially periodically and alternately providing the first and second common voltages to the display panel repeatedly every first period when the input image data represents the still image, wherein the first common voltage having a first level is provided to the display panel during a first duration, wherein the second common voltage having a second level different from the first level is provided to the display panel during a second duration, wherein the first duration and the second duration are continuous, and wherein the first and second common voltages have the shape of a square wave in the first period.

2. The method of claim 1, further comprising:

accumulating a residual DC voltage at a pixel of the display panel during a first duration during which the first common voltage is provided; and removing the accumulated residual DC voltage during a second duration during which the second common voltage is provided.

3. The method of claim 1, further comprising providing only the first common voltage to the display panel when the input image data represents the video image.

4. The method of claim 1, further comprising generating a third common voltage, wherein the first and third common voltages are substantially periodically and alternately provided to the display panel when the input image data represents the video image, and wherein the difference between the first and second common voltages is greater than the difference between the first and third common voltages.

5. The method of claim 4, further comprising determining a driving frequency of the display panel based on the input image data, wherein the difference between the first and second common voltages and the difference between the first and third common voltages are determined based on the driving frequency of the display panel.

6. The method of claim 1, further comprising substantially periodically and alternately providing the first and second common voltages to the display panel repeatedly every second period when the input image data represents the video image, wherein the first period is less than the second period.

7. The method of claim 6, further comprising determining a driving frequency of the display panel based on the input image data, wherein the first and second periods are determined based on the driving frequency of the display panel.

8. The method of claim 1, wherein as the first period increases, the difference between the first and second common voltages increases, and wherein as the first period decreases, the difference decreases.

9. The method of claim 1, wherein the difference between the first and second common voltages is substantially equal to or less than about 1% of the first common voltage.

10. A method of driving a display panel, the method comprising:

providing input image data;

generating first and second gamma reference voltages different from each other for a same grayscale in a same polarity;

generating a common voltage;

providing the common voltage to the display panel;

determining whether the input image data represents a still image or a video image;

generating first and second data voltages based on the first and second gamma reference voltages, the first and second data voltages being different from each other for a same grayscale in a same polarity; and substantially periodically and alternately providing the first and second data voltages to the display panel repeatedly every first period when the input image data represents the still image.

11. The method of claim 10, further comprising:

accumulating a residual DC voltage at a pixel of the display panel during a first duration during which the first data voltage is provided; and removing the accumulated residual DC voltage during a second duration during which the second data voltage is provided.

12. The method of claim 10, further comprising substantially periodically and alternately providing only the first data voltage to the display panel when the input image data represents the video image.

13. A method of driving a display panel, the method comprising:

providing input image data;

generating first and second gamma reference voltages different from each other;

generating a common voltage;

providing the common voltage to the display panel;

determining whether the input image data represents a still image or a video image;

generating first and second data voltages based on the first and second gamma reference voltages;

substantially periodically and alternately providing the first and second data voltages to the display panel repeatedly every first period when the input image data represents the still image; and generating a third data voltage, wherein the first and third data voltages are substantially periodically and alternately provided to the display panel when the input image data represents the video image, and wherein the difference between the first and second data voltages for the same grayscale is greater than the difference between the first and third data voltages for the same grayscale.

14. The method of claim 10, further comprising substantially periodically and alternately providing the first and second data voltages to the display panel repeatedly every second period when the input image data represents the video image, wherein the first period is less than the second period.

15. A display device, comprising:

a display panel configured to display an image based on input image data;

a gamma reference voltage generator configured to generate a gamma reference voltage;

a timing controller configured to determine whether the input image data represents a still image or a video image;

a data driver configured to i) generate a data voltage based on the gamma reference voltage and the input image data, and ii) provide the data voltage to the display panel; and a common voltage generator configured to i) generate first and second common voltages different from each other, and ii) substantially periodically and alternately provide the first and second common voltages to the display panel repeatedly every first period when the input image data represents the still image, wherein the first common voltage having a first level is provided to the display panel during a first duration, wherein the second common voltage having a second level different from the first level is provided to the display panel during a second duration, wherein the first duration and the second duration are continuous, wherein the common voltage generator is further configured to substantially periodically and alternately provide the first and second common voltages to the display panel repeatedly every second period when the input image data represents the video image, and wherein the first period is less than the second period.

16. A display device, comprising:

a display panel configured to display an image based on input image data;

a gamma reference voltage generator configured to generate a gamma reference voltage;

a timing controller configured to determine whether the input image data represents a still image or a video image;

a data driver configured to i) generate a data voltage based on the gamma reference voltage and the input image data, and ii) provide the data voltage to the display panel; and a common voltage generator configured to i) generate first and second common voltages different from each other, and ii) substantially periodically and alternately provide the first and second common voltages to the display panel repeatedly every first period when the input image data represents the still image, wherein the first common voltage having a first level is provided to the display panel during a first duration, wherein the second common voltage having a second level different from the first level is provided to the display panel during a second duration, wherein the first duration and the second duration are continuous, wherein the common voltage generator is further configured to i) generate a third common voltage, and ii) substantially periodically and alternately provide the first and the third common voltages to the display panel when the input image data represents the video image, and wherein the difference between the first and second common voltages is greater than the difference between the first and third common voltage.

17. A display device, comprising:

a display panel configured to display an image based on input image data;

a gamma reference voltage generator configured to i) generate first and second gamma reference voltages different from each other for a same grayscale in a same polarity, and ii) provide the first and second gamma reference voltages to the display panel;

a timing controller configured to determine whether the input image data represents a still image or a video image;

a data driver configured to i) generate first and second data voltages based on the first and second gamma reference voltages, the first and second data voltages being different from each other for a same grayscale in a same polarity, and ii) substantially periodically and alternately provide the first and second data voltages to the display panel repeatedly every first period when the input image data represents the still image; and a common voltage generator configured to i) generate a common voltage, and ii) provide the common voltage to the display panel.

18. The display device of claim 17, wherein the common voltage generator is further configured to substantially periodically and alternately provide the first and second common voltages to the display panel repeatedly every second period when the input image data represents the video image, and wherein the first period is less than the second period.

19. A display device comprising:

a display panel configured to display an image based on input image data;

a gamma reference voltage generator configured to i) generate first and second reference voltages different from each other, and ii) provide the first and second gamma reference voltages to the display panel;

a timing controller configured to determine whether the input image data represents a still image or a video image;

a data driver configured to i) generate first and second data voltages based on the first and second gamma reference voltages, and ii) substantially periodically and alternately provide the first and second data voltages to the display panel repeatedly every first period when the input image data represents the still image; and a common voltage generator configured to i) generate a common voltage, and ii) provide the common voltage to the display panel, wherein the common voltage generator is further configured to i) generate a third common voltage, and ii) substantially periodically and alternately provide the first and third common voltages to the display panel when the input image data represents the video image, and wherein the difference between the first and second common voltages is greater than the difference between the first and third common voltages.

* * * * *